US011019950B2

(12) United States Patent
Sorbara

(10) Patent No.: US 11,019,950 B2
(45) Date of Patent: Jun. 1, 2021

(54) DRINKING STRAW AND METHOD FOR MANUFACTURING A DRINKING STRAW

(71) Applicant: Tetra Laval Holdings & Finance S.A., Pully (CH)

(72) Inventor: Angelo Sorbara, Rubiera (IT)

(73) Assignee: Tetra Laval Holdings & Finance S.A., Pully (CH)

( * ) Notice: Subject to any disclaimer, the term of this patent is extended or adjusted under 35 U.S.C. 154(b) by 6 days.

(21) Appl. No.: 16/342,720

(22) PCT Filed: Oct. 12, 2017

(86) PCT No.: PCT/EP2017/076082

§ 371 (c)(1),
(2) Date: Apr. 17, 2019

(87) PCT Pub. No.: WO2018/073096

PCT Pub. Date: Apr. 26, 2018

(65) Prior Publication Data

US 2019/0290039 A1 Sep. 26, 2019

(30) Foreign Application Priority Data

Oct. 21, 2016 (EP) ..... 16195103

(51) Int. Cl.
*A47G 21/00* (2006.01)
*A47G 21/18* (2006.01)

(52) U.S. Cl.
CPC ..... *A47G 21/18* (2013.01)

(58) Field of Classification Search
CPC ..... A47G 21/18; A47G 21/182; A47G 21/183
USPC ..... 239/16, 33
See application file for complete search history.

(56) References Cited

U.S. PATENT DOCUMENTS 214,617 A * 4/1879 Brown ..... A47G 21/18 239/33
478,861 A * 7/1892 Howard ..... A47G 21/18 239/33
581,767 A * 5/1897 Powers ..... B62J 9/22 239/33

(Continued)

FOREIGN PATENT DOCUMENTS

CN 201987190 U 9/2011
CN 202553356 U 11/2012

(Continued)

OTHER PUBLICATIONS

International Search Report and Written Opinion in corresponding PCT Application No. PCT/EP2017/076082 dated Feb. 2, 2018 (7 pages).

(Continued)

*Primary Examiner* — Viet Le
(74) *Attorney, Agent, or Firm* — Finnegan, Henderson, Farabow, Garrett & Dunner LLP

(57) ABSTRACT

A drinking straw comprises a tubular body (21) intended to define a passage for a liquid product and a tip portion (22) intended to pierce a pierceable portion of a container to allow consumption of the liquid product, wherein said tip portion (22) is bounded by two stiffness promoting elements (25) obtained by bending and permanently deforming said tubular body.

11 Claims, 3 Drawing Sheets

(56) References Cited

U.S. PATENT DOCUMENTS 585,058 A * 6/1897 Stone ..... A47G 21/18 138/115
662,345 A * 11/1900 Britton ..... A47G 21/18 239/33
674,446 A * 5/1901 Marx ..... A47G 21/181 30/141
754,948 A * 3/1904 White ..... F16L 58/16 138/145
1,000,332 A * 8/1911 Dyer ..... C02F 1/002 210/251
1,001,218 A * 8/1911 Parenteau ..... C02F 1/002 239/33
1,012,193 A * 12/1911 Deffner ..... A47G 21/18 239/33
1,466,185 A * 8/1923 Pick ..... A47G 21/18 239/33
1,494,742 A * 5/1924 Hills ..... A47G 21/183 30/141
1,680,341 A * 8/1928 Hills ..... B65D 51/28 215/11.1
1,735,144 A * 11/1929 Tanner ..... A47G 19/2222 215/391
2,036,773 A * 4/1936 Prudden ..... A47G 21/18 138/128
2,150,439 A * 3/1939 Hamilton ..... B65D 77/283 239/33
2,279,396 A * 4/1942 Hanson, Jr. ..... B65D 77/283 239/33
2,370,931 A * 3/1945 Bogin ..... A47G 21/187 62/293
2,531,855 A * 11/1950 Loptson ..... A47G 21/18 239/33
2,570,366 A * 10/1951 Mitchell ..... A47G 21/183 239/33
2,599,919 A * 6/1952 Hucknall ..... A47G 19/2266 220/710
2,613,107 A * 10/1952 Hartnett ..... A47G 21/181 239/33
2,613,988 A * 10/1952 Jarbeau ..... B65D 77/283 239/33
2,617,559 A * 11/1952 Van Der Spek ..... B65D 77/283 222/83
2,689,149 A * 9/1954 Saltzman ..... A47G 21/18 239/33
2,811,808 A * 11/1957 Briese ..... A47G 21/182 446/72
2,815,981 A * 12/1957 Nonnamaker ..... A47G 21/183 239/33
2,844,267 A * 7/1958 Petriccione ..... B65D 77/283 215/388
2,859,515 A * 11/1958 Kinman ..... A47G 21/181 30/141
2,882,729 A * 4/1959 Welser ..... A47G 19/2227 73/317
2,979,267 A * 4/1961 Miller ..... A47G 21/181 239/33
3,025,004 A * 3/1962 Levi ..... A47G 21/186 239/33
3,109,590 A * 11/1963 Graham ..... A47G 21/18 239/33
3,168,982 A * 2/1965 Davis ..... A47G 21/18 239/33
3,211,379 A * 10/1965 Burton ..... B65D 77/283 239/33
3,398,624 A * 8/1968 Stoessel ..... G10D 7/12 84/330
3,718,282 A * 2/1973 Pizzoferrato ..... A47G 21/183 239/33
D241,702 S * 10/1976 Aykanian ..... D7/300.2
D317,543 S * 6/1991 Small ..... D7/300.2
5,039,012 A * 8/1991 Inaba ..... A47G 21/18 215/388
5,054,631 A * 10/1991 Robbins, III ..... A47G 21/18 215/229
5,114,074 A * 5/1992 Frauenthal ..... A47G 21/18 215/388
5,201,460 A * 4/1993 Caines ..... A47G 21/18 215/388
5,460,264 A * 10/1995 Rupert ..... B65D 23/12 206/217
5,722,590 A * 3/1998 Miller ..... A47G 21/182 239/33
5,820,023 A * 10/1998 Kristensson ..... A47G 21/189 239/33
5,950,857 A * 9/1999 Rosen ..... A47G 19/2272 215/10
6,010,034 A * 1/2000 Walthers ..... A47G 19/2266 222/129
6,283,294 B1 * 9/2001 Thorball ..... A23L 2/52 206/438
6,321,977 B1 * 11/2001 Lee ..... B65D 77/28 220/705
7,011,255 B2 * 3/2006 Zuccaro ..... A47G 21/18 215/388
7,997,509 B2 * 8/2011 Karklins ..... B65D 83/0005 239/33
8,342,422 B2 * 1/2013 Claessens ..... A47G 21/18 239/33
9,820,597 B1 * 11/2017 Chang ..... B23K 26/364
10,058,203 B1 * 8/2018 Stirbis ..... A47G 21/18
2001/0023899 A1 * 9/2001 Hosi ..... A47G 21/18 239/33
2003/0071136 A1 * 4/2003 Ference ..... A47G 21/18 239/33
2004/0069861 A1 * 4/2004 Kuwagaki ..... A47G 21/18 239/24
2004/0195347 A1 * 10/2004 Kim ..... A47G 21/185 239/33
2004/0222312 A1 * 11/2004 Zuccaro ..... A47G 21/18 239/33
2005/0051639 A1 * 3/2005 Scott ..... A47G 21/18 239/33
2005/0061822 A1 * 3/2005 Naesje ..... A47G 21/18 220/705
2006/0027675 A1 * 2/2006 Takeda ..... A47G 21/183 239/33
2006/0065757 A1 * 3/2006 Calabrese ..... A47G 21/18 239/16
2006/0201955 A1 * 9/2006 Stribling ..... A47G 21/185 220/705
2008/0169356 A1 * 7/2008 Trejo ..... A47G 19/2266 239/33
2008/0197141 A1 * 8/2008 Felfoldi ..... A47G 21/183 220/705
2009/0314852 A1 * 12/2009 Fabrizio ..... A47G 21/181 239/33
2010/0092309 A1 * 4/2010 Hockemeier ..... A47G 21/18 417/53
2010/0155500 A1 * 6/2010 Zaccheo ..... A47G 21/188 239/33
2010/0258498 A1 * 10/2010 Finelli ..... A47G 21/188 210/473
2012/0056008 A1 * 3/2012 Claessens ..... A47G 21/183 239/33
2012/0228400 A1 * 9/2012 Baron ..... A47G 21/183 239/33
2013/0020402 A1 * 1/2013 Wallace ..... A47G 21/18 239/33
2013/0092750 A1 * 4/2013 Liu ..... A47G 21/18 239/33
2014/0263718 A1 * 9/2014 Marouthis ..... A61C 15/02 239/33
2015/0173543 A1 * 6/2015 Dommarco Lindenthal-Breier ..... A47G 21/181 239/33
2019/0290039 A1 * 9/2019 Sorbara ..... A47G 21/18

(56) References Cited

U.S. PATENT DOCUMENTS

| | | | | |
|---|---|---|---|---|
| 2019/0313819 | A1* | 10/2019 | Li | A47G 21/186 |
| 2020/0069094 | A1* | 3/2020 | Tsai | A47G 21/18 |
| 2020/0085218 | A1* | 3/2020 | Huang | A47G 21/18 |

FOREIGN PATENT DOCUMENTS

| | | | |
|---|---|---|---|
| CN | 203121943 | U | 8/2013 |
| CN | 105007783 | A | 10/2015 |
| JP | 2004-275596 | A | 10/2004 |
| WO | WO 2014-140199 | A1 | 9/2014 |

OTHER PUBLICATIONS

Chinese Office Action dated Mar. 20, 2020, in corresponding Chinese Application no. 201780051197.3 (9 pages).

* cited by examiner

DRINKING STRAW AND METHOD FOR MANUFACTURING A DRINKING STRAW

CROSS-REFERENCE TO RELATED PATENT APPLICATIONS

This is a National Phase of International Application No. PCT/EP2017/076082, filed Oct. 12, 2017, which claims the benefit of European Application No. 16195103.3 filed Oct. 21, 2016. The entire contents of the above-referenced applications are expressly incorporated herein by reference.

The invention relates to a drinking straw for use with a package containing a liquid product.

The invention further relates to method for manufacturing a drinking straw for use with a package containing a liquid product.

As is known, many liquid or pourable food products, such as fruit juice, UHT (ultra-high-temperature treated) milk, wine, tomato sauce, etc., are sold in packages made of sterilized packaging material.

A typical example is the parallelepiped-shaped package for liquid or pourable food products known as Tetra Brik Aseptic (registered trademark), which is made by folding and sealing laminated sheet packaging material.

With particular reference to FIG. 1, the packaging material 2 comprises a base layer 4 for stiffness and strength, which may be made of fibrous material, e.g. paper, or mineral-filled polypropylene material, and a first covering layer 5*a* and a second covering layer 5*b*, made of heat-sealable plastic material, e.g. polyethylene films, and covering both sides of the base layer 4. In the case of an aseptic container for long-storage products, such as UHT milk, the packaging material 2 also comprises a barrier layer 6 made of gas-barrier material, e.g. aluminium foil or ethyl vinyl alcohol (EVOH) film, which is superimposed on the second covering layer 5*b* and is in turn covered with a third covering layer 5*c*, made of heat-sealable plastic material, e.g. a polyethylene film, forming the inner face of the container eventually contacting the food product. In other words, the first covering layer 5*a*, the second covering layer 5*b*, the barrier layer 6 and the third covering layer 5*c* define lamination layers applied to the base layer 4 when producing packaging material 3 in the form of a continuous sheet.

The packages may comprise a pierceable portion that can be broken so as to define an opening through which a drinking straw can be inserted into the package and allow consumption of the liquid product.

FIG. 1 shows a pierceable portion 8 obtained by punching a hole 9 through the base layer 4 of the packaging material 2 and covering the hole 9 with the above-mentioned lamination layers, so that the hole 9 is sealed by a respective sheet cover portion 10.

FIG. 2 shows a known drinking straw 11 comprising a tubular body 12, for example made from a hollow tube of plastic material. The drinking straw 11 comprises a tip 13 intended to pierce the pierceable portion 8.

A drawback of the known solutions is that a high piercing force may be needed to break the pierceable portion, in particular in case the sheet cover portion (i.e. the above-mentioned lamination layers) is made of a strong material.

An object of the invention is to improve the known drinking straws.

Another object of the invention is to provide a drinking straw that can easily pierce a pierceable portion of a package.

In a first aspect of the invention, there is provided a drinking straw comprising a tubular body intended to define a passage for a liquid product and a tip portion intended to pierce a pierceable portion of a container to allow consumption of the liquid product, characterized in that said tip portion is bounded by two stiffness promoting elements obtained by bending and permanently deforming said tubular body.

In a second aspect of the invention, there is provided a method for manufacturing a drinking straw comprising the step of providing a drinking straw having a tubular body intended to define a passage for a liquid product and a tip portion intended to pierce a pierceable portion of a container to allow consumption of the liquid product, characterized in that the method further comprises the step of bending and permanently deforming said tubular body so has to form two stiffness promoting elements that bound said tip portion.

Owing to the invention, it is possible to increase the stiffness of the tip element. In this way, it is much easier for the user to break the pierceable portion.

In particular, the tip portion can easily penetrate the pierceable portion also in case the pierceable portion is made of a strong material, or a plurality of layers or strong materials.

The known drinking straws are subjected to damages and deformation when they are manufactured, when they are supplied to an applicator device, when they are applied to packages by the applicator device and when the packages they are applied to are conveyed and handled.

The piercing action of the known drinking straws, therefore, may be adversely effected by the above-mentioned damages and deformations. This means that penetrating the pierceable portion with a deformed, or damaged, drinking straw may be very difficult, or even impossible.

Owing to the increased stiffness, the drinking straw is much more resistant to deformations and damages when compared to the known drinking straws.

The invention will be better understood and carried out with reference to the enclosed drawings, which show some exemplifying and non limiting embodiments thereof, in which:

FIGS. 4 and 5 show a first embodiment of a drinking straw 20.

Figure 1:
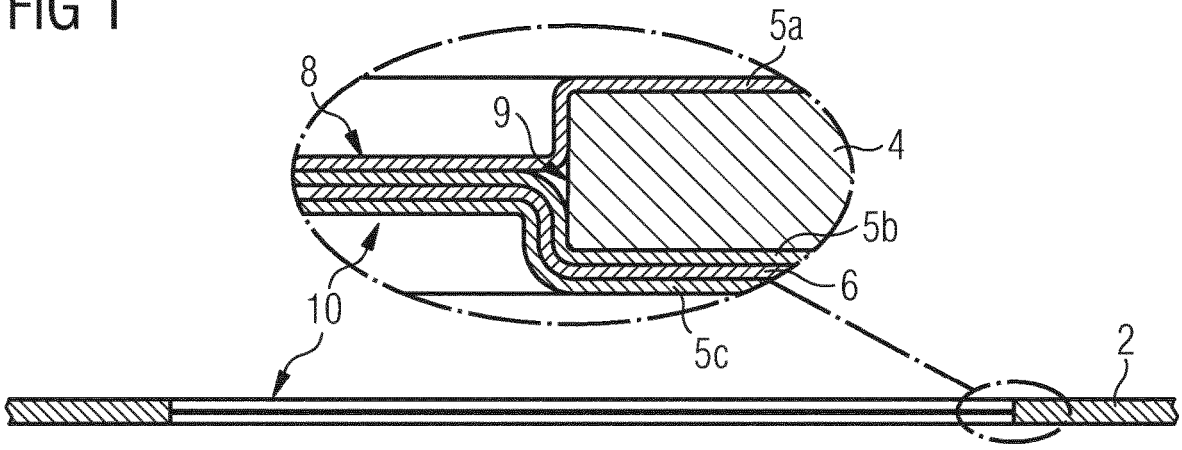
FIG. 1 is cross section showing a pierceable portion of a container.
Figure 3:
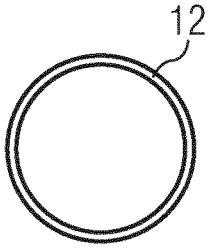
FIG. 3 is a front view of the drinking straw of FIG. 2.
Figure 2:
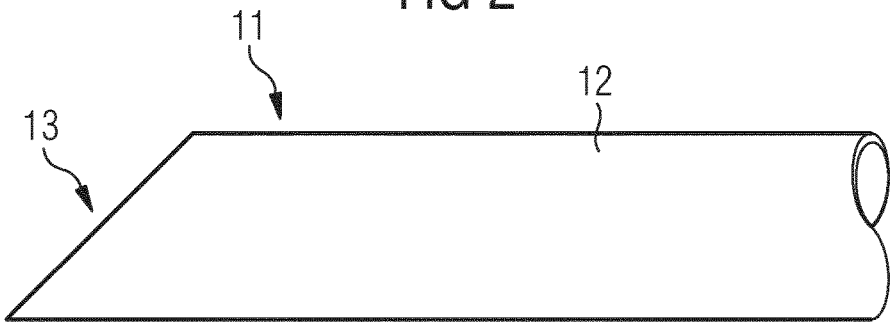
FIG. 2 is a side view of a know drinking straw.

The drinking straw 20 comprises a tubular body 21 intended to define a passage for a liquid product.

The drinking straw 20 further comprises a tip portion 22 intended to pierce a pierceable portion of a container to allow consumption of the liquid product packed in the container.

The drinking straw 20 comprises a suction hole 23 arranged on a plane P which forms and angle $\alpha$ with a reference plane R perpendicular to a longitudinal axis A of the tubular body 21.

In this way, the tip portion 22 is provided with a pointed end 24 that is arranged on a longitudinal symmetry plane S of the drinking straw 20.

The tip portion 22 is bounded by two stiffness promoting elements 25 obtained by bending and permanently deforming the tubular body 21.

In particular, the tubular body 21 is bent and permanently deformed along a first bending line 26, a second bending line 27 and a third bending line 28.

The first bending line 26 and the second bending line 27 are arranged on opposite sides of the longitudinal symmetry plane S and the third bending line 28 is arranged on the longitudinal symmetry plane S.

The first bending line 26 and the second bending line 27 are symmetrical with respect to the longitudinal symmetry plane S.

The stiffness promoting elements 25 comprise a first rib and a second rib 30 that are arranged on opposite sides of the longitudinal symmetry plane S and converge at the pointed end 24.

The first rib 29 and the second rib 30 are symmetrical with respect to the longitudinal symmetry plane S.

The first rib 29 is delimited by the first bending line 26 and the third bending line 28.

The second rib 30 is delimited by the second bending line 27 and the third bending line 28.

Figure 7:
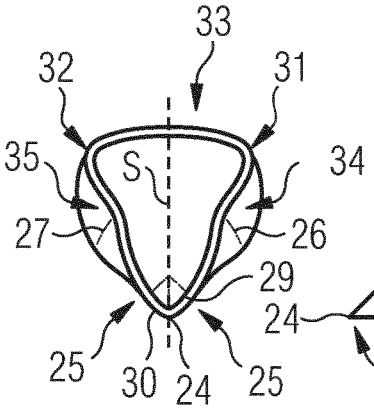
FIG. 7 is a front view of the drinking straw of FIG. 6.
Figure 6:
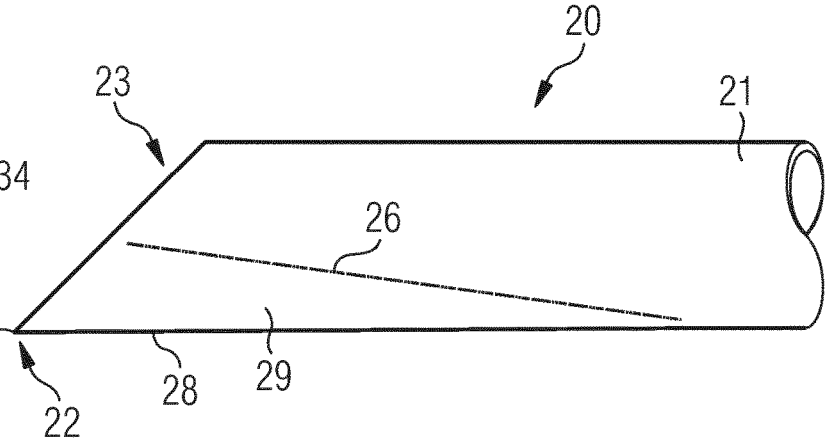
FIG. 6 is a side view of a second embodiment of a drinking straw according to the invention.

FIGS. 6 and 7 show a second embodiment of a drinking straw 20.

The drinking straw 20 according to the second embodiment differs from the drinking straw 20 according to the first embodiment in that the tubular body 21 is also bent and permanently deformed along a fourth bending line 31 and a fifth bending line 32.

The fourth bending line 31 and the fifth bending line 32 are arranged on opposite sides of the longitudinal symmetry plane S.

The fourth bending line 31 and the fifth bending line 32 are symmetrical with respect to the longitudinal symmetry plane S.

A third rib 33 is defined between the fourth bending line 31 and the fifth bending line 32.

The third rib 33 extends across the longitudinal symmetry plane S.

The third rib 33 is symmetrical with respect to the longitudinal symmetry plane S.

A first stiffening area 34 is defined between the first bending line 26 and the fourth bending line 31.

A second stiffening area 35 is defined between the second bending line 27 and the fifth bending line 32.

The first stiffening area 34 is interposed between the first rib 29 and the third rib 33.

The second stiffening area 35 is interposed between the second rib 30 and the third rib 33.

The first stiffening area 34 and the second stiffening area 35 are arranged on opposite sides of the longitudinal symmetry plane S.

The first stiffening area 34 and the second stiffening area 35 are symmetrical with respect to the longitudinal symmetry plane S.

Figure 8:
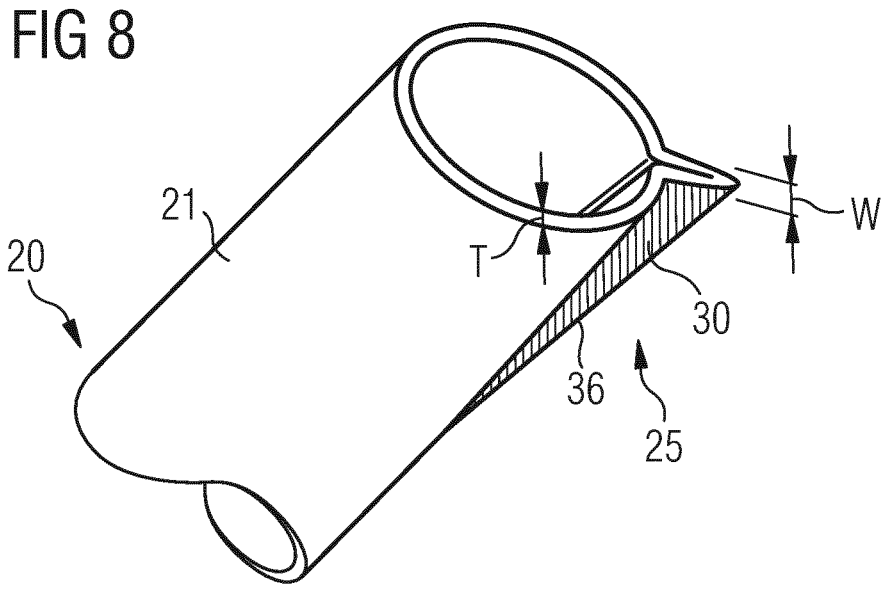
FIG. 8 is a perspective view of a third embodiment of a drinking straw according to the invention.

FIG. 8 shows a third embodiment of a drinking straw 20.

The drinking straw 20 according to the third embodiment differs from the drinking straw 20 according to the first embodiment in that the stiffening promoting elements 25 are joined to each other to define a piercing body 36.

In particular, the first rib 29 is permanently attached to the second rib 30.

According to a possible variant, the first rib 29 and the second rib 30 are heat-sealed to each other. This may be obtained, for example, by means of ultrasonic sealing.

According to another possible variant, the first rib 29 and the second rib 30 are glued to each other.

The piercing body 36 has a width W that is twice the thickness T of the tubular body.

In this way, the piercing body 36 has an increased stiffness.

Figure 9:
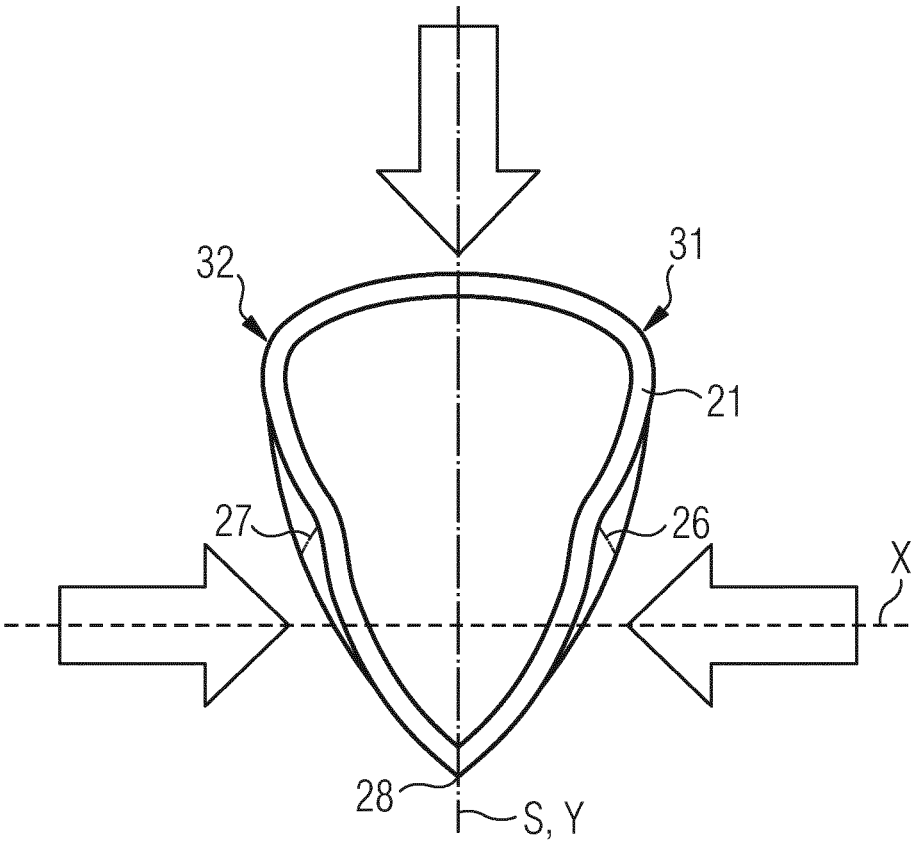
FIG. 9 is a schematic view that shows the steps of a method for manufacturing the drinking straw of FIGS. 6 and 7.

FIG. 9 shows in a schematic way a method for manufacturing the drinking straw of FIGS. 6 and 7.

The method comprises a first step during which the tubular body 21 is compressed along a first direction X perpendicular to the longitudinal symmetry plane S. In this way, the tubular body is bent and permanently deformed so as to form the first bending line 26, the second bending line 27 and the third bending line 28.

The method further comprises a second step during which the tubular body 21 is compressed along a second direction Y parallel to the longitudinal symmetry plane S. In this way, the tubular body is bent and permanently deformed so as to form the fourth bending line 31 and the fifth bending line 32.

Figure 5:
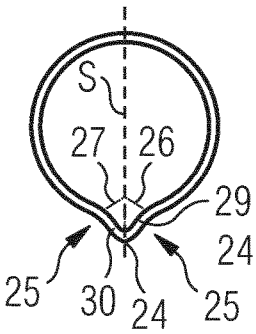
FIG. 5 is a front view of the drinking straw of FIG. 4.
Figure 4:
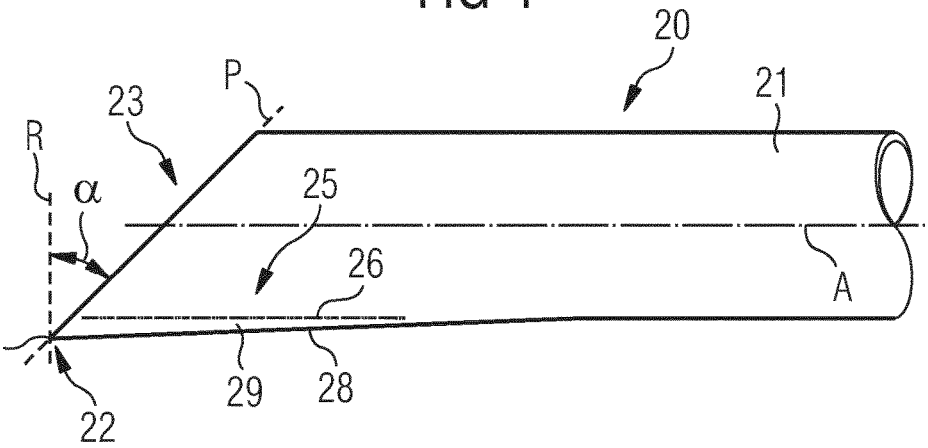
FIG. 4 is a side view of a first embodiment of a drinking straw according to the invention.

A method for manufacturing the drinking straw of FIGS. 4 and 5 may comprise only the first step disclosed above.

A method for manufacturing the drinking straw of Figure may comprise the first step disclosed above and a second step during which the stiffness promoting elements 25 are joined to each other to define the piercing body 36.

In particular, during the second step the first rib 29 is permanently attached to the second rib 30.

The second step may comprise the step of heat sealing, for example ultrasonically heat sealing, the first rib 29 and the second rib 30 to each other.

The second step may comprise the step of gluing the first rib 29 and the second rib 30 to each other.

Owing to the invention, it is possible to increase the stiffness of the drinking straw, in particular of the tip portion of the drinking straw. In this way, a user can break the pierceable portion of a container much more easily than in the case of known drinking straws.

In addition, owing to the invention, it is possible to highly enhance the stiffness of the drinking straw without correspondingly increasing the cost of the drinking straw. This because the increased stiffness is obtained by bending and permanently deforming the tubular body so as to form the stiffness promoting means. In other words, the increased stiffness in not obtained by using a stronger (and more expensive) material compared with the known drinking straws, but by providing the tubular body with stiffness promoting means. In this way, a more effective piercing action may be obtained using the same material (and therefore at substantially the same cost) as the known drinking straws.

Moreover, the increased stiffness of the drinking straw is advantageous not only when breaking the pierceable portion, but also during handling and transportation of the drinking straw. The stiffer drinking straw according to the invention, in fact, is much more resistant and less subjected to damages and deformations.

The invention claimed is:

1. A drinking straw for use with a liquid product in a container, the drinking straw comprising:

a tubular body configured to define a passage for the liquid product;

a tip portion configured to pierce a pierceable portion of the container to allow consumption of the liquid product; and two stiffness promoting elements, bounding the tip portion, obtained by bending and permanently deforming the tubular body;

wherein the drinking straw comprises a first bending line, a second bending line and a third bending line along which the tubular body is bent and permanently deformed to obtain the stiffness promoting elements;

wherein the first bending line and the second bending line are arranged on opposite sides of a longitudinal symmetry plane of the drinking straw and the third bending line is arranged on the longitudinal symmetry plane;

wherein the stiffness promoting elements comprise a first rib and a second rib that are arranged on opposite sides of the longitudinal symmetry plane of the drinking straw and converge at a pointed end of the tip portion; and wherein the first rib is delimited by the first bending line and the third bending line and the second rib is delimited by the second bending line and the third bending line.

2. A drinking straw according to claim 1, wherein the drinking straw comprises a fourth bending line and a fifth bending line along which the tubular body is bent and permanently deformed.

3. A drinking straw according to claim 2, wherein a third rib is defined between the fourth bending line and the fifth bending line.

4. A drinking straw according to claim 3, wherein a first stiffening area is defined between the first bending line and the fourth bending line and a second stiffening area is defined between the second bending line and the fifth bending line.

5. A drinking straw according to claim 4, wherein the first stiffening area is interposed between the first rib and the third rib and the second stiffening area is interposed between the second rib and the third rib.

6. A drinking straw according to claim 1, wherein the stiffening promoting elements are joined to each other to define a piercing body.

7. A drinking straw according to claim 6, wherein the first rib is permanently attached to the second rib.

8. A drinking straw according to claim 1, wherein the drinking straw comprises a suction hole arranged on a plane which forms at an angle with a reference plane perpendicular to a longitudinal axis of the tubular body, such that the tip portion is provided with a pointed end that is arranged on a longitudinal symmetry plane of the drinking straw.

9. A method for manufacturing a drinking straw for use with a liquid product in a container, the method comprising:

providing a tubular body configured to define a passage for the liquid product;

providing a tip portion on the tubular body, wherein the tip portion is configured to pierce a pierceable portion of the container to allow consumption of the liquid product; and bending and permanently deforming the tubular body to form two stiffness promoting elements that bound the tip portion by compressing the tubular body along a first direction perpendicular to a longitudinal symmetry plane of the drinking straw so as to form a first bending line, a second bending line and a third bending line;

wherein the first bending line and the second bending line are arranged on opposite sides of the longitudinal symmetry plane of the drinking straw and the third bending line is arranged on the longitudinal symmetry plane;

wherein the stiffness promoting elements comprise a first rib and a second rib that are arranged on opposite sides of the longitudinal symmetry plane of the drinking straw and converge at a pointed end of the tip portion; and wherein the first rib is delimited by the first bending line and the third bending line and the second rib is delimited by the second bending line and the third bending line.

10. A method according to claim 9, further comprising:

compressing the tubular body along a second direction parallel to the longitudinal symmetry plane so as to form a fourth bending line and a fifth bending line.

11. A method according to claim 9, further comprising:

joining the stiffness promoting elements together to define a piercing body.

* * * * *